US012790148B2

(12) United States Patent
Seto

(10) Patent No.: US 12,790,148 B2
(45) Date of Patent: Nov. 10, 2026

(54) SHEET FEEDING APPARATUS AND IMAGE FORMING APPARATUS

(71) Applicant: CANON KABUSHIKI KAISHA, Tokyo (JP)

(72) Inventor: Masaki Seto, Shizuoka (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 7 days.

(21) Appl. No.: 18/984,239

(22) Filed: Dec. 17, 2024

(65) Prior Publication Data

US 2025/0206552 A1 Jun. 26, 2025

(30) Foreign Application Priority Data

Dec. 20, 2023 (JP) ..... 2023-215200

(51) Int. Cl.
*B65H 3/06* (2006.01)
*B65H 1/04* (2006.01)

(52) U.S. Cl.
CPC ..... *B65H 3/0684* (2013.01); *B65H 1/04* (2013.01); *B65H 2404/15* (2013.01); *B65H 2601/324* (2013.01); *B65H 2801/06* (2013.01)

(58) Field of Classification Search
CPC ... B65H 3/06; B65H 3/0684; B65H 2601/324
See application file for complete search history.

(56) References Cited

U.S. PATENT DOCUMENTS

| | | | | |
|---|---|---|---|---|
| 5,927,703 | A | 7/1999 | Endo | |
| 9,617,091 | B2 | 4/2017 | Matsuo et al. | |
| 10,196,221 | B2 * | 2/2019 | Okamoto | B65H 3/0669 |
| 11,981,526 | B2 | 5/2024 | Yoshida | |
| 12,195,291 | B2 * | 1/2025 | Takashima | B65H 3/0684 |

FOREIGN PATENT DOCUMENTS

| | | | |
|---|---|---|---|
| JP | H05744 | A | 1/1993 |
| JP | H09235033 | A | 9/1997 |
| JP | 2006219260 | A | 8/2006 |
| JP | 2016011213 | A | 1/2016 |
| JP | 2023016162 | A | 2/2023 |
| JP | 2023081540 | A | 6/2023 |

* cited by examiner

*Primary Examiner* — Jeremy R Severson
(74) *Attorney, Agent, or Firm* — ROSSI, KIMMS & McDOWELL LLP

(57) ABSTRACT

A sheet feeding apparatus includes an apparatus body, a stacking portion, a feed roller unit including a feed roller and a holding member, a first urging member configured to bias the holding member, and a detachable unit configured to be detachably supported by at least one of the feed roller unit and the apparatus body, the detachable unit including a second urging member configured to bias the holding member. A feed pressure applied to the sheet in a case where the feed roller feeds the sheet stacked on the stacking portion (i) becomes a first feed pressure by the first urging member and the second urging member in a state where the detachable unit is attached, and (ii) becomes a second feed pressure different from the first feed pressure by the first urging member in a state where the detachable unit is detached.

20 Claims, 11 Drawing Sheets

SHEET FEEDING APPARATUS AND IMAGE FORMING APPARATUS

BACKGROUND OF THE INVENTION

Field of the Invention

The present invention relates to a sheet feeding apparatus that feeds a sheet and an image forming apparatus including the same.

Description of the Related Art

JP H09-235033 A proposes a printing machine including a feed pressure adjustment mechanism capable of changing a feed pressure when a sheet is fed by a feed roller. The feed roller is held by a feeding arm so as to be movable up and down. The feed pressure adjustment mechanism includes a pressurizing arm that pressurizes the feed arm, a pressurizing spring that energizes the pressurizing arm, a rack that changes an urgent force of the pressurizing spring, and a feed pressure variable motor that drives the rack.

In addition, a feeding device including a pickup roll, a roll support that supports the pickup roll so as to be movable up and down, a sliding member movable in the horizontal direction with respect to the roll support, and a weight provided at an end of the sliding member has been proposed (see JP H05-744 A). The sliding member is moved by a gear driven by a motor, and the distance between the weight and the pickup roll changes as the sliding member moves, and as a result, the feed pressure changes.

However, in both of JP H09-235033 A and JP H05-744 A, the feed pressure is varied by the motor, and for example, for a user who uses only a specific type of sheet and does not need to adjust the feed pressure, the apparatus is complicated and causes an increase in cost.

Therefore, there is need for providing a sheet feeding apparatus capable of adjusting the feed pressure with a simple configuration and at low cost, and an image forming apparatus including the sheet feeding apparatus.

SUMMARY OF THE INVENTION

According to a first aspect of the present invention, a sheet feeding apparatus includes an apparatus body, a stacking portion configured to be supported by the apparatus body and stack a sheet, a feed roller unit including a feed roller configured to feed the sheet stacked on the stacking portion, and a holding member configured to swingably hold the feed roller, a first urging member configured to bias the holding member such that the feed roller presses the sheet stacked on the stacking portion, and a detachable unit configured to be detachably supported by at least one of the feed roller unit and the apparatus body, the detachable unit including a second urging member configured to bias the holding member. A feed pressure applied to the sheet in a case where the feed roller feeds the sheet stacked on the stacking portion (i) becomes a first feed pressure by the first urging member and the second urging member in a state where the detachable unit is attached, and (ii) becomes a second feed pressure different from the first feed pressure by the first urging member in a state where the detachable unit is detached.

According to a second aspect of the present invention, a sheet feeding apparatus includes an apparatus body, a stacking portion configured to be supported by the apparatus body and stack a sheet, a feed roller unit including a feed roller configured to feed the sheet stacked on the stacking portion, and a detachable unit configured to adjust a feed pressure applied to the sheet in a case where the feed roller feeds the sheet stacked on the stacking portion. The detachable unit is configured to be detachably supported by at least one of the feed roller unit and the apparatus body. The feed pressure becomes a first feed pressure in a state where the detachable unit is attached, and becomes a second feed pressure different from the first feed pressure in a state where the detachable unit is detached.

Further features of the present invention will become apparent from the following description of exemplary embodiments with reference to the attached drawings.

DESCRIPTION OF THE EMBODIMENTS

First Embodiment

Overall Configuration

Figure 1:
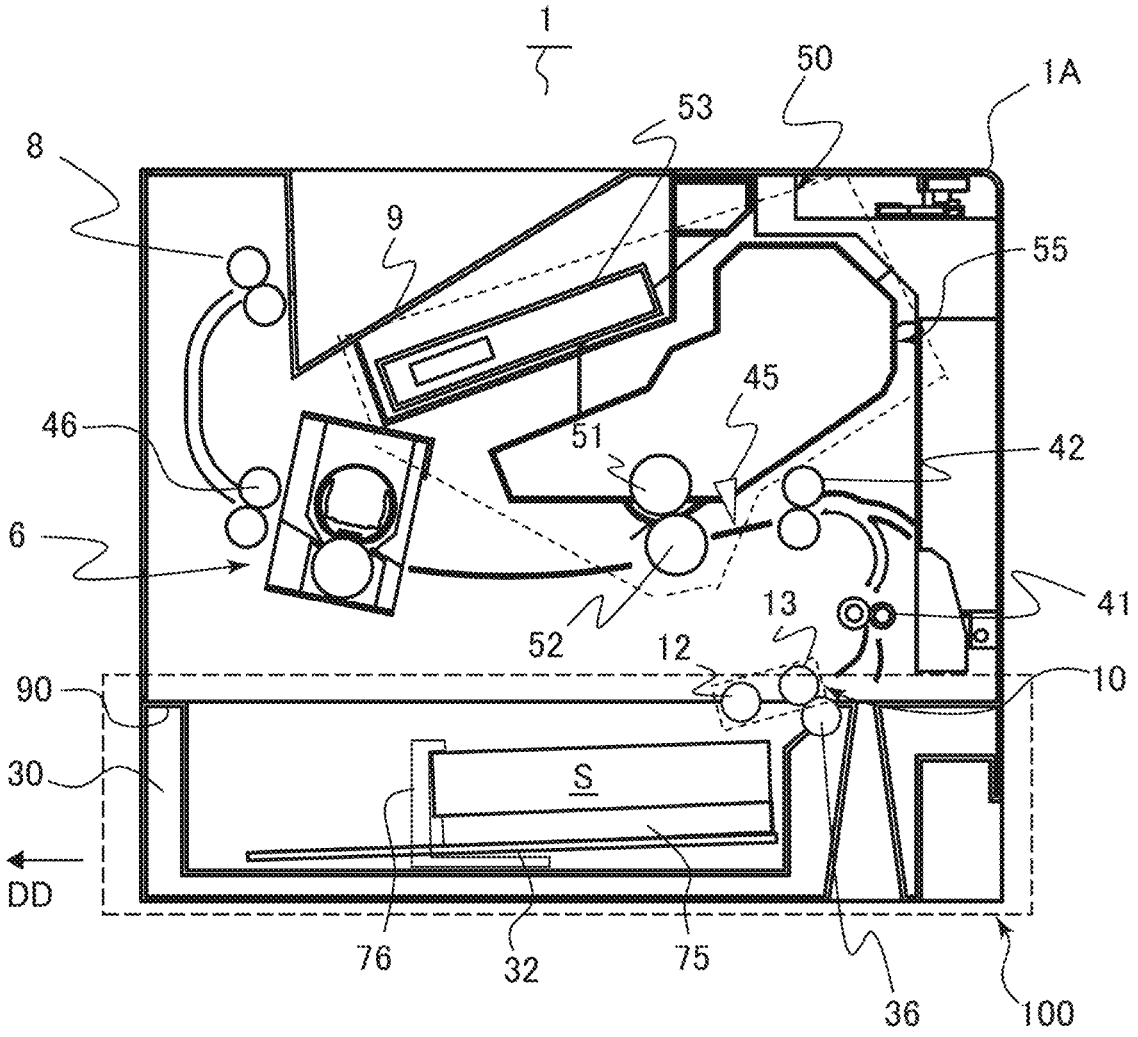
FIG. 1 is an overall schematic view illustrating an image forming apparatus according to a first embodiment.

First, a first embodiment of the present invention will be described. As illustrated in FIG. 1, an image forming apparatus 1 of the present embodiment is an electrophotographic system of a laser beam printer that forms a monochrome toner image. As illustrated in FIG. 1, the image forming apparatus 1 includes a sheet feeding apparatus 100 that feeds a stacked sheet, and an image forming unit 50 that forms an image on the fed sheet. The image forming apparatus 1 includes a fixing unit 6 that fixes an image transferred to the sheet, and a sheet discharge roller pair 8 that can discharge the sheet to a sheet discharge tray 9.

Note that the image forming apparatus includes a printer, a copier, a facsimile, and a multifunction peripheral, and refers to an apparatus that forms an image on a sheet used as a recording medium on the basis of image information input from an external PC or image information read from a document. In addition to a main body having an image forming function, the image forming apparatus may be connected to an accessory device such as an option feeder, an image reading apparatus, or a sheet processing apparatus, and the entire system to which such an accessory device is connected is also a type of the image forming apparatus. The sheet includes paper such as paper sheets and envelopes, plastic films such as sheets for an overhead projector (OHP), clothes, and the like. The sheet feeding apparatus 100 described later includes an option feeder and the like independent of the image forming apparatus 1.

When an image forming command is output to the image forming apparatus 1, the image forming process by the image forming unit 50 is started on the basis of image information input from an external computer or the like connected to the image forming apparatus 1. The image forming unit 50 includes a process cartridge 55, a laser scanner 53, and a transfer roller 52. The process cartridge 55 includes a photosensitive drum 51 rotatable while carrying a toner image, and a charging roller, a developing roller, and a cleaning blade (not illustrated) arranged along the photosensitive drum 51. The process cartridge 55 is detachable from an apparatus body 1A of the image forming apparatus 1.

The laser scanner 53 irradiates the photosensitive drum 51 with laser light on the basis of the input image information. At this time, the photosensitive drum 51 is charged in advance by a charging roller, and an electrostatic latent image is formed on the photosensitive drum 51 by being irradiated with laser light. Thereafter, the electrostatic latent image is developed by the developing roller, and a monochrome toner image is formed on the photosensitive drum 51.

In parallel with the above-described image forming process, a sheet S is fed from the sheet feeding apparatus 100. The sheet feeding apparatus 100 includes a cassette 30 supported so as to be drawn out in a pulling-out direction DD with respect to the apparatus body 1A, and the cassette 30 as a stacking portion is configured to be able to stack the sheet S. The sheet S stored in the cassette 30 is fed by a pickup roller 12, and the sheets S fed by the pickup roller 12 are separated one by one by a feed roller 13 and a separation roller 36 that comes into pressure contact with the feed roller 13. The separation roller 36 is biased toward the feed roller 13 by a separation spring 37 (see FIG. 6C).

A torque limiter is incorporated in the separation roller 36. When one sheet is conveyed to the separation nip formed by the feed roller 13 and the separation roller 36, the limit value of the torque limiter is set such that the separation roller 36 is driven to rotate by the feed roller 13. When a plurality of sheets are conveyed to the separation nip, the separation roller 36 stops without being driven along with the feed roller 13. Driving may be input to the separation roller 36 so as to convey the sheet in a direction opposite to the sheet conveyance direction by the feed roller 13. Further, in the present embodiment, the cassette 30 having only one stage is provided, but a plurality of cassettes capable of supporting sheets of different sizes may be provided, and the sheets may be fed in accordance with the sheet size selected from the plurality of cassettes.

The sheet S separated one by one by the feed roller 13 and the separation roller 36 is conveyed to a registration roller pair 42 by a conveyance roller pair 41, and skew feeding is corrected by the registration roller pair 42. The leading edge of the sheet S conveyed at a predetermined conveyance timing by the registration roller pair 42 is detected by a registration sensor 45. The image forming unit 50 starts forming a toner image on the photosensitive drum 51 based on the detection of the leading edge of the sheet S by the registration sensor 45. Then, the toner image on the photosensitive drum 51 is transferred to the sheet S by the electrostatic load bias applied to the transfer roller 52. The residual toner left on the photosensitive drum 51 is collected by a cleaning blade.

Predetermined heat and pressure are applied to the sheet S with a transferred toner image by the heating roller and the pressure roller of the fixing unit 6, and the toner is melted and bonded (fixed). The sheet S having passed through the fixing unit 6 is conveyed to the sheet discharge roller pair 8 by a conveyance roller pair 46, and discharged to the sheet discharge tray 9 by the sheet discharge roller pair 8.

Outline of Sheet Feeding Apparatus

Figure 2:
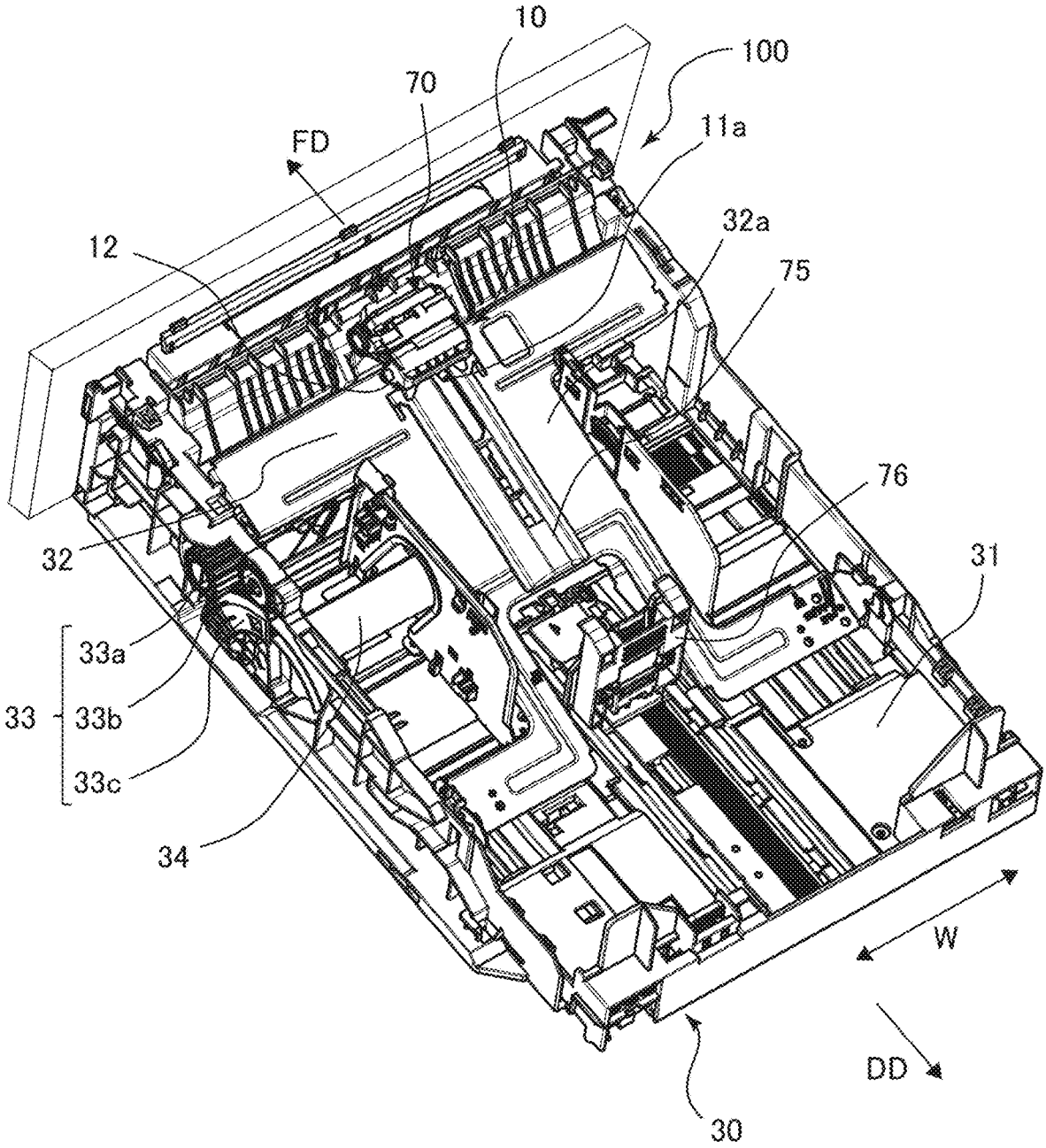
FIG. 2 is a perspective view illustrating a cassette and a feed roller unit.
Figure 3A:
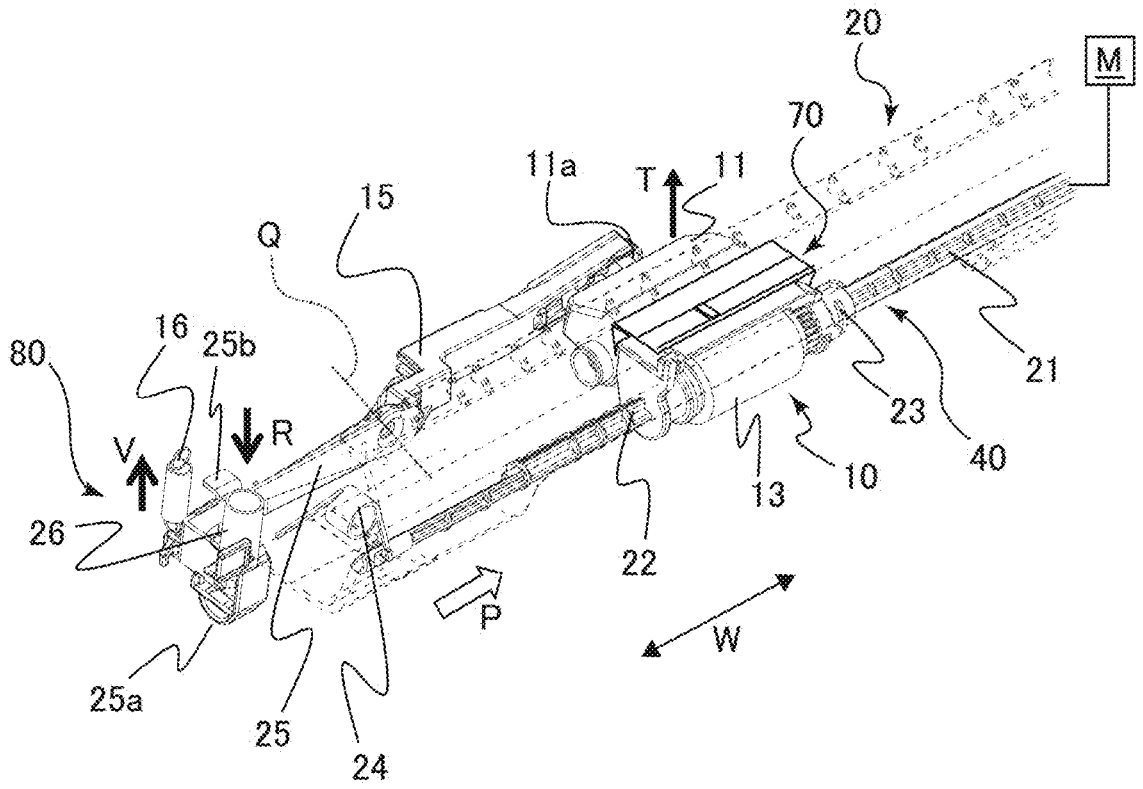
FIG. 3A is a perspective view illustrating a sheet feed unit.
Figure 3B:
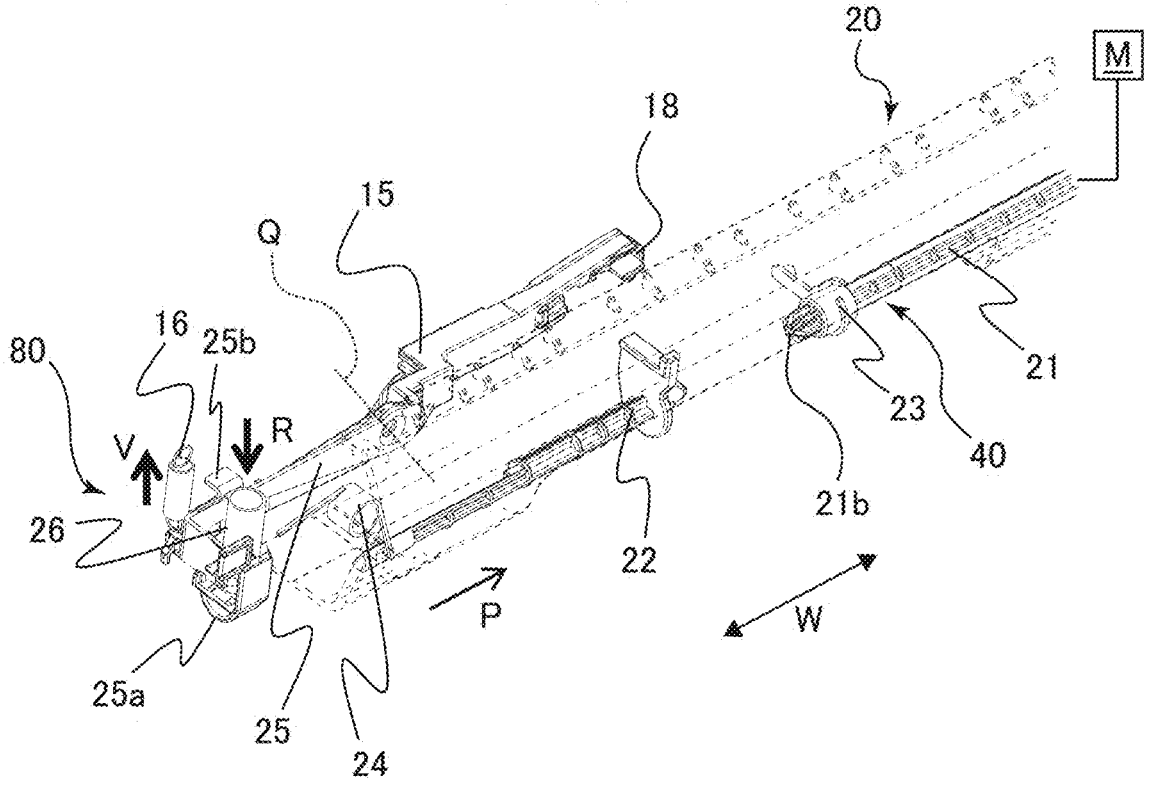
FIG. 3B is a perspective view illustrating a state in which the feed roller unit is detached from the roller support unit of the sheet feed unit.

Next, an outline of the sheet feeding apparatus 100 will be described. FIG. 2 is a perspective view illustrating a cassette 30 and a feed roller unit 10. FIG. 3A is a perspective view illustrating a sheet feed unit 20, and FIG. 3B is a perspective view illustrating a state in which the feed roller unit 10 is detached from a roller support unit 40 of the sheet feed unit 20. In FIG. 2, the roller support unit 40 is omitted.

As illustrated in FIGS. 2 to 3B, the sheet feeding apparatus 100 includes a part of the apparatus body 1A, a sheet feed unit 20, a motor M for supplying a driving force to the sheet feed unit 20, and a cassette 30. The sheet feed unit 20 includes a roller support unit 40, a feed roller unit 10, a swing mechanism 80 that swings the feed roller unit 10, and a feed pressure adjustment mechanism 70 as a detachable unit to be detachably supported by the feed roller unit 10.

Cassette

Next, the configuration of the cassette 30 will be described with reference to FIG. 2. As illustrated in FIG. 2, the cassette 30 includes a cassette body 31, an intermediate plate 32 which is pivotably supported by the cassette body 31 and serves as a supporting member on which the sheet S is stacked, a lifter plate 34, and a lifter drive train 33 which drives the lifter plate 34. In addition, the cassette 30 includes a trailing edge regulation member 76 that regulates the position of the upstream end in a sheet feeding direction FD of the sheet S stacked on the intermediate plate 32. The trailing edge regulation member 76 is supported to be movable in a direction along the sheet feeding direction FD with respect to the cassette body 31.

The lifter drive train 33 includes a first gear 33*a* driven by a motor (not illustrated), a lifter gear 33*c* provided integrally with the lifter plate 34, and a second gear 33*b* that meshes with the first gear 33*a* and the lifter gear 33*c* and is rotatably supported by the cassette body 31. The first gear 33*a* is driven by a motor, for example, when a print job is input to the image forming apparatus 1 or when the cassette 30 is attached to the apparatus body 1A. Rotation of the first gear 33*a* is transmitted to the lifter gear 33*c* via the second gear 33*b*, and the lifter plate 34 integrated with the lifter gear 33*c* pivots. As a result, the intermediate plate 32 is pressed by the lifter plate 34 from below, and the intermediate plate 32 rises (pivots).

In the present embodiment, an envelope placing table 75 as an attachment member is detachably supported on an upper surface 32*a* of the intermediate plate 32. The envelope placing table 75 is disposed at the center of the intermediate plate 32 in a sheet width direction W orthogonal to the sheet feeding direction FD, and is disposed so as to overlap the pickup roller 12 in the sheet width direction W. For example, an envelope can be placed on the envelope placing table 75, and the width of the envelope placing table 75 is smaller than the width of the envelope to be placed in the sheet width direction W. Therefore, the envelope placing table 75 can swingably support an envelope serving as a sheet in the sheet width direction W.

As a result, the envelope stacked on the envelope placing table 75 swings in the sheet width direction W by the envelope placing table 75 even if the envelope is stored in the cassette 30 in a state where the height of the bundle is unbalanced in the width direction (left-right direction) due to overlapping of curls or flaps. As a result, the uppermost envelope in the bundle is in a posture along the substantially horizontal direction. Therefore, the pickup roller 12 can uniformly apply the feed pressure to the envelope stored in the cassette 30, and can reduce feeding failure such as skew feeding of the envelope.

Sheet Feed Unit

Figure 4A:
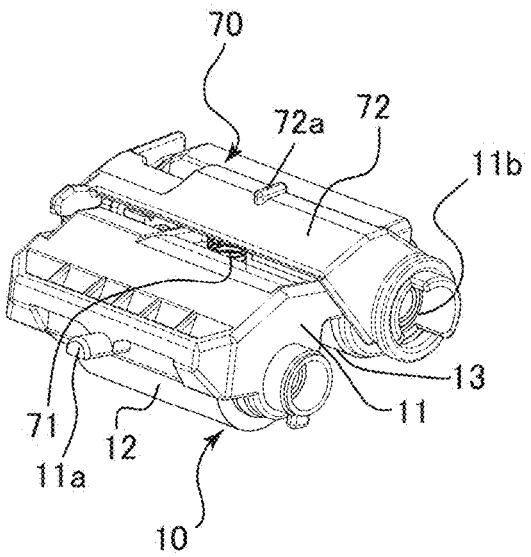
FIG. 4A is a perspective view illustrating a feed roller unit and a feed pressure adjustment mechanism.
Figure 4B:
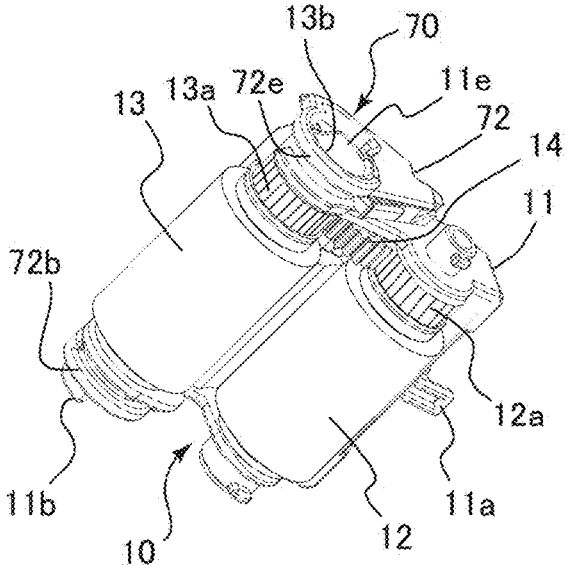
FIG. 4B is another perspective view illustrating the feed roller unit and the feed pressure adjustment mechanism.
Figure 4C:
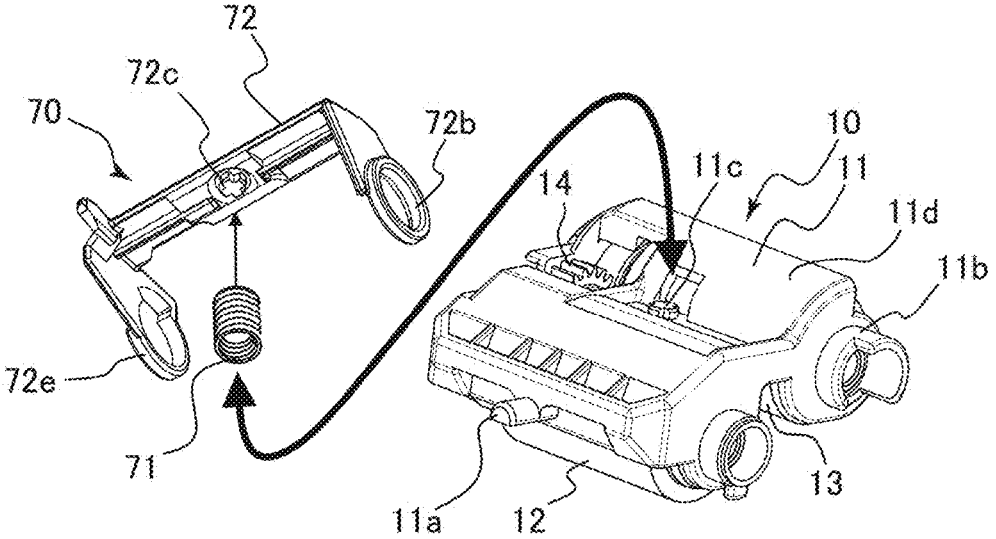
FIG. 4C is an exploded perspective view illustrating the feed roller unit and the feed pressure adjustment mechanism.

Next, a configuration of the sheet feed unit 20 will be described with reference to FIGS. 3A to 5B. FIG. 4A is a perspective view illustrating the feed roller unit 10 and the feed pressure adjustment mechanism 70, and FIG. 4B is another perspective view illustrating the feed roller unit 10 and the feed pressure adjustment mechanism 70. FIG. 4C is an exploded perspective view illustrating the feed roller unit 10 and the feed pressure adjustment mechanism 70.

As illustrated in FIGS. 3A and 3B, the sheet feed unit 20 includes a roller support unit 40 supported by the apparatus body 1A, a feed roller unit 10 detachably supported by the roller support unit 40, and a swing mechanism 80. The roller support unit 40 includes a feed shaft 21, a slide shaft 22, a feed bearing 23, and a slide spring 24.

The feed shaft 21 and the slide shaft 22 are supported by the apparatus body 1A and extend in the sheet width direction W. A coupling portion 21*b* is provided at a first end portion of the feed shaft 21 in the sheet width direction W, and the coupling portion 21*b* transmits the rotation to the feed roller 13 of the feed roller unit 10. The slide shaft 22 is slidable in the sheet width direction W, and is biased in the direction of arrow P in the sheet width direction W by the slide spring 24.

As illustrated in FIGS. 4A to 4C, the feed roller unit 10 includes a roller holder 11, a pickup roller 12, a feed roller 13, and an idler gear 14. The roller holder 11 as a holding member rotatably supports the pickup roller 12, the feed roller 13, and the idler gear 14. Gear portions 12*a* and 13*a* are provided in the first end portions of the pickup roller 12 and the feed roller 13, respectively, and the idler gear 14 meshes with these gear portions 12*a* and 13*a*. A coupling hole 13*b* is provided at the axial center of the feed roller 13.

The roller holder 11 includes a boss 11*a* extending upstream in the sheet feeding direction FD in a state where the feed roller unit 10 is attached to the roller support unit 40, and a bearing portion 11*b* engageable with the slide shaft 22. The bearing portion 11*b* is provided on a first end side of the feed roller 13 in the sheet width direction W.

In a state where the feed roller unit 10 is attached to the roller support unit 40 as illustrated in FIG. 3A, the coupling portion 21*b* of the feed shaft 21 is engaged with the coupling hole 13*b* (see FIG. 4B) of the feed roller 13. As a result, when the feed shaft 21 is rotated by the driving force of the motor M, the rotation of the feed shaft 21 is transmitted to the feed roller 13 via the coupling portion 21*b* and the coupling hole 13*b*. The rotation of the feed roller 13 is transmitted to the pickup roller 12 as a feed roller via the gear portion 13*a*, the idler gear 14, and the gear portion 12*a*.

The slide shaft 22 is engaged with the bearing portion 11*b* of the roller holder 11, and the feed roller unit 10 is supported by the feed shaft 21 and the slide shaft 22. At this time, the slide shaft 22 is provided with a rib (not illustrated) for controlling the posture of the feed roller unit 10. In a state where the feed roller unit 10 is supported by the roller support unit 40, the rotation axes of the feed shaft 21, the slide shaft 22, and the feed roller 13 are coaxial. The attachment/detachment operation of the feed roller unit 10 with respect to the roller support unit 40 will be described later.

Figure 5A:
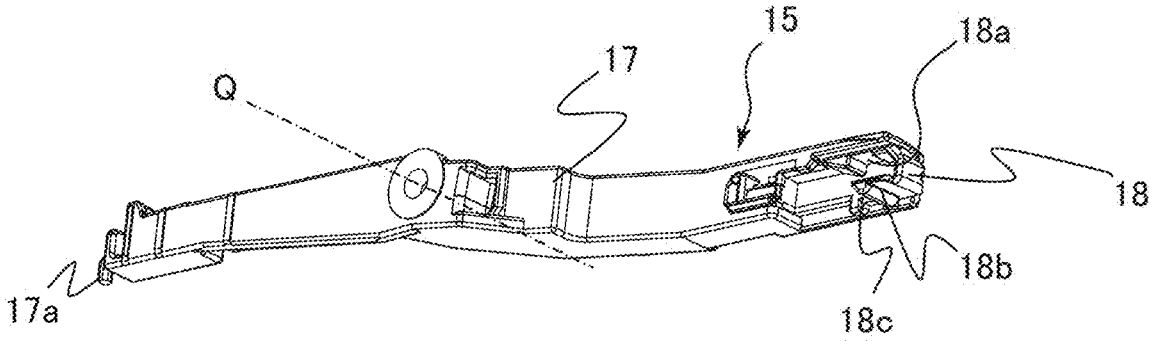
FIG. 5A is a perspective view illustrating an arm unit of a swing mechanism.
Figure 5B:
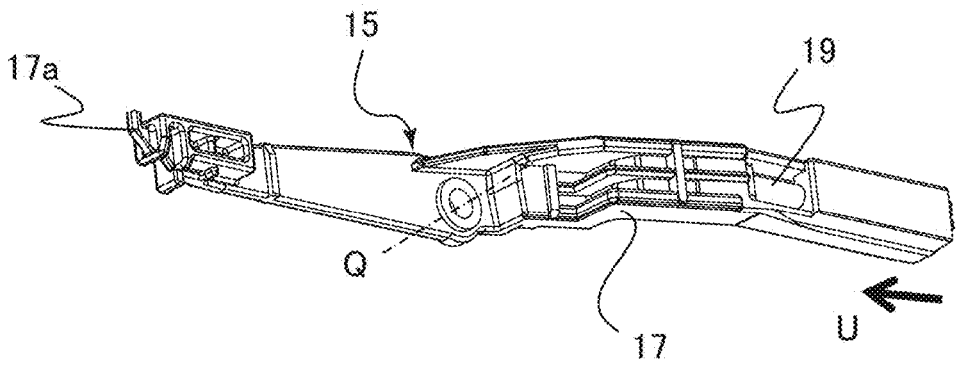
FIG. 5B is another perspective view illustrating the arm unit.

Next, the swing mechanism 80 will be described with reference to FIGS. 3A to 5B. FIG. 5A is a perspective view illustrating an arm unit 15 of the swing mechanism 80, and FIG. 5B is another perspective view illustrating the arm unit 15. As illustrated in FIGS. 3A and 3B, the swing mechanism 80 includes an arm unit 15, a first feed pressure spring 16, a separation arm 25, and a separation spring 26. The arm unit 15 and the separation arm 25 are each independently provided to be pivotal about a rotation fulcrum Q.

As illustrated in FIGS. 5A and 5B, the arm unit 15 as the swing portion includes an arm 17, a cap 18, and a cap spring 19. The arm 17 is pivotably supported with respect to the apparatus body 1A about the rotation fulcrum Q. The arm 17 includes a spring hooking portion 17*a* to which the first feed pressure spring 16 (see FIG. 3A) is attached.

The cap 18 is supported so as to be movable in the direction of arrow U or the direction opposite to the direction of arrow U with respect to the arm 17, and is disposed on the opposite side to the spring hooking portion 17*a* with the rotation fulcrum Q interposed therebetween. The cap spring 19 is disposed between the arm 17 and the cap 18, and biases the cap 18 in the direction of arrow U. The cap 18 as the contact portion is provided with a concave portion 18*a*, an engagement portion 18*b*, and a tapered portion 18*c*. The boss 11*a* (see FIG. 4A) of the roller holder 11 is engaged with the engagement portion 18*b* in a state where the feed roller unit 10 is attached to the roller support unit 40 and the cassette 30 is detached from the apparatus body 1A.

As illustrated in FIGS. 3A and 3B, the separation arm 25 is provided with a cassette contact portion 25*a* capable of being brought in contact with the cassette 30 and an arm engagement portion 25*b* capable of engaging with the arm unit 15. The separation spring 26 biases the separation arm 25 in the direction of arrow R (downward), and the movement of the separation spring 26 in the direction of arrow R is regulated by abutting on a stopper (not illustrated). On the other hand, the first feed pressure spring 16 biases the arm unit 15 in the direction of arrow V (upward). The direction of arrow R and the direction of arrow V are opposite to each other, and the urgent force of the separation spring 26 is set to be larger than the urgent force of the first feed pressure spring 16.

In the present embodiment, each of the first feed pressure spring 16 and the separation spring 26 is formed of a compression coil spring, but is not limited thereto. For example, the first feed pressure spring 16 and the separation spring 26 may be urging members such as a leaf spring, a torsion bar, a rubber member, and a sponge.

Feed Pressure Adjustment Mechanism

Next, the feed pressure adjustment mechanism 70 will be described with reference to FIGS. 4A to 4C. As illustrated in FIGS. 4A to 4C, the feed pressure adjustment mechanism 70 includes a second feed pressure spring 71 and a spring holder 72. The spring holder 72 as a first contact member includes bearing portions 72*b* and 72*e*, a boss 72*c*, and an abutment portion 72*a*, and the bearing portions 72*b* and 72*e* are pivotably supported by the bearing portions 11*b* and 11*e* of the roller holder 11. The bearing portions 72*b* and 72*e* and the bearing portions 11*b* and 11*e* are disposed on opposite sides of the feed roller 13. The abutment portion 72*a* can be in contact with a contact portion 20*a* provided on the apparatus body 1A.

A top surface boss 11*c* as a support portion is provided on a top surface 11*d* of the roller holder 11. In a state where the spring holder 72 is attached to the roller holder 11, the second feed pressure spring 71 is attached to each of the boss 72*c* of the spring holder 72 and the top surface boss 11*c* of the roller holder 11. That is, the top surface boss 11*c* is in contact with the second feed pressure spring 71 in a state where the feed pressure adjustment mechanism 70 is attached to the feed roller unit 10. The bearing portion 72*b* of the spring holder 72 is provided with a groove 72*f*, and the spring holder 72 has a pivoting range with respect to the roller holder 11 limited by engagement of a rib (not illustrated) provided in the roller holder 11 with the groove 72*f*. Thus, the second feed pressure spring 71 provided between the roller holder 11 and the spring holder 72 is configured not to fall off from the roller holder 11 and the spring holder 72. The second feed pressure spring 71 is disposed at a position shifted from the feed shaft 21 and the slide shaft 22, which are the pivot axis of the roller holder 11, in plan view, and biases the roller holder 11.

In the present embodiment, the second feed pressure spring 71 as a second urging member is formed of a compression coil spring, but is not limited thereto. For example, the second feed pressure spring 71 may be an elastic member such as a leaf spring, a torsion bar, a rubber member, or a sponge.

Operation of Swing Mechanism and Feed Pressure Adjustment Mechanism

Figure 6A:
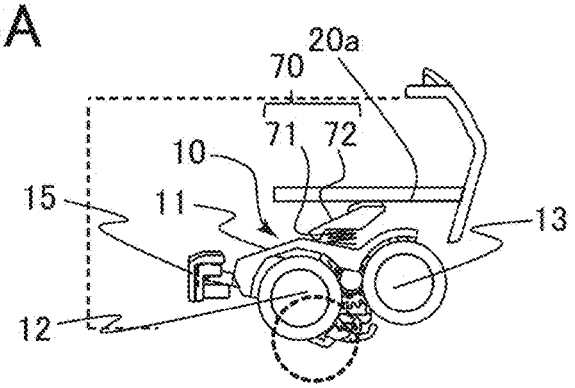
FIG. 6A is a side view illustrating the feed roller unit and the feed pressure adjustment mechanism in a state where the cassette is detached from an apparatus body.
Figure 6B:
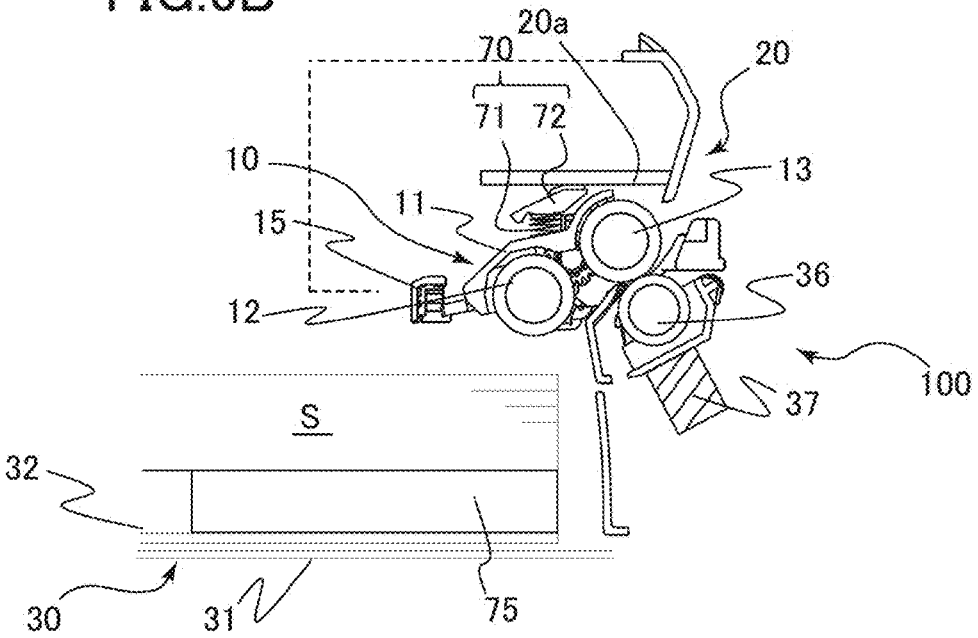
FIG. 6B is a side view illustrating the feed roller unit and the feed pressure adjustment mechanism in a state where the cassette is attached to the apparatus body.
Figure 6C:
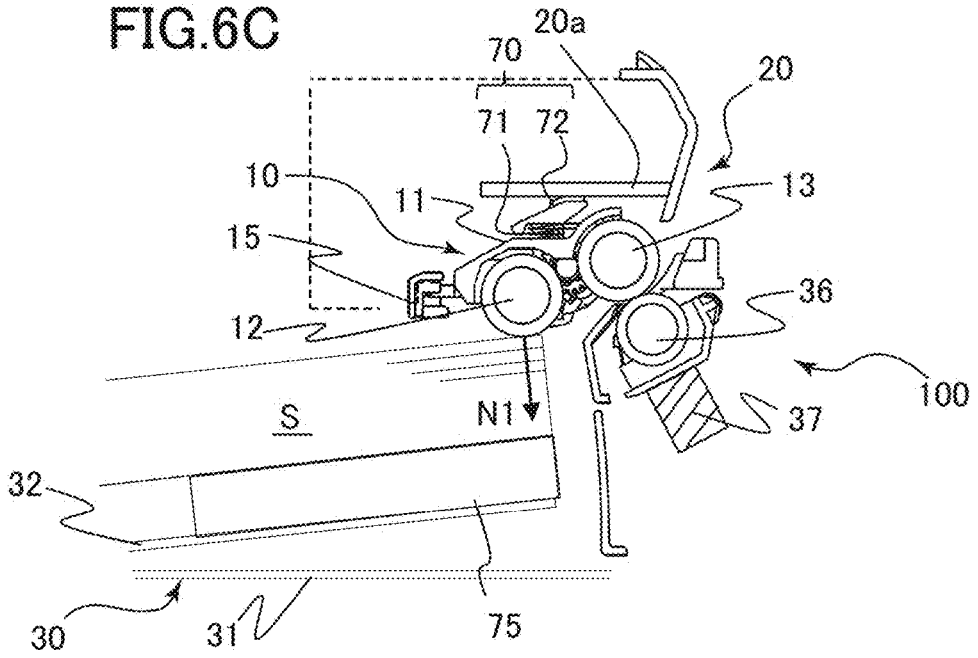
FIG. 6C is a side view illustrating the feed roller unit and the feed pressure adjustment mechanism when an intermediate plate rises from the state of FIG. 6B.

Next, the operations of the swing mechanism 80 and the feed pressure adjustment mechanism 70 will be described with reference to FIGS. 6A to 6C. FIG. 6A is a side view illustrating the feed roller unit 10 and the feed pressure adjustment mechanism 70 in a state where the cassette 30 is detached from the apparatus body 1A. FIG. 6B is a side view illustrating the feed roller unit 10 and the feed pressure adjustment mechanism 70 in a state where the cassette 30 is attached to the apparatus body 1A. FIG. 6C is a side view illustrating the feed roller unit 10 and the feed pressure adjustment mechanism 70 when the intermediate plate 32 rises from the state of FIG. 6B.

In the following description, it is assumed that the feed roller unit 10 is attached to the roller support unit 40. As illustrated in FIG. 6A, when the cassette 30 is detached from the apparatus body 1A, the cassette contact portion 25*a* of the separation arm 25 illustrated in FIG. 3A is separated from the cassette 30. Therefore, the separation arm 25 pivots about the rotation fulcrum Q by the urgent force of the separation spring 26 in the direction of arrow R. As a result, the arm engagement portion 25*b* provided in the separation arm 25 presses the arm unit 15 downward. At this time, since the urgent force of the first feed pressure spring 16 is weaker than the urgent force of the separation spring 26, the arm unit 15 pivots about the rotation fulcrum Q in the direction of arrow R, that is, the direction opposite to the direction of arrow V.

As a result, the engagement portion 18*b* (see FIG. 5A) of the cap 18 provided at the end of the arm unit 15 pushes up the boss 11*a* of the roller holder 11. Therefore, the feed roller unit 10 including the roller holder 11 pivots in the direction of arrow T about the feed shaft 21 and the slide shaft 22. That is, when the cassette 30 is pulled out from the apparatus body 1A, the pickup roller 12 is raised by the swing mechanism 80. For example, the pickup roller 12 moves from a second position indicated by a broken line in FIG. 6A to a first position indicated by a solid line in FIG. 6A.

Such rising of the pickup roller 12 is started at an initial stage when the cassette 30 starts to rise from the apparatus body 1A. This is realized by the cam shape of the cassette body 31 in contact with the cassette contact portion 25*a*. As a result, it is possible to suppress catching between the pickup roller 12 and the sheet S on the intermediate plate 32 and to improve the detachability of the cassette 30.

Then, as illustrated in FIGS. 3A and 6B, when the cassette 30 is attached to the apparatus body 1A, the cassette contact portion 25*a* is pushed up against the urgent force of the separation spring 26 by the cam shape of the cassette body 31. As a result, the arm engagement portion 25*b* provided in the separation arm 25 also rises. Since the arm unit 15 is pressed against the arm engagement portion 25*b* by the urgent force of the first feed pressure spring 16, the arm unit pivots in the direction of arrow V about the rotation fulcrum Q together with the separation arm 25.

Then, the concave portion 18*a* (see FIG. 5A) of the cap 18 provided at the end of the arm unit 15 pushes down the boss 11*a* of the roller holder 11. Therefore, the feed roller unit 10 including the roller holder 11 pivots in a direction opposite to the direction of arrow T about the feed shaft 21 and the slide shaft 22. That is, when the cassette 30 is attached to the apparatus body 1A, the pickup roller 12 is lowered from the first position indicated by the solid line in FIG. 6A to the second position indicated by the broken line in FIG. 6A by the swing mechanism 80. This is because the first feed pressure spring 16 biases the pickup roller 12 toward the second position via the arm unit 15.

At this time, the abutment portion 72*a* provided on the top surface of the spring holder 72 of the feed pressure adjustment mechanism 70 provided in the feed roller unit 10 is in contact with the contact portion 20*a* provided in the apparatus body 1A. The pickup roller 12 located at the second position is not in contact with the sheet S stacked on the intermediate plate 32.

Thereafter, as illustrated in FIG. 6C, when the intermediate plate 32 rises, the uppermost sheet S stacked on the intermediate plate 32 and the pickup roller 12 come into contact with each other. Then, when the intermediate plate 32 further rises by a predetermined amount, the pickup roller 12 rises from the second position to a third position illustrated in FIG. 6C by the sheet S stacked on the intermediate plate 32. When the pickup roller 12 rises, the feed roller unit 10 rises in the direction of arrow T illustrated in FIG. 3A around the feed shaft 21 and the slide shaft 22. As a result, the boss 11*a* of the roller holder 11 pushes up the arm unit 15. That is, the arm unit 15 pivots in the direction of arrow R about the rotation fulcrum Q. When the pickup roller 12 rises from the second position to the third position, the concave portion 18*a* of the cap 18 of the arm unit 15 and the boss 11*a* maintain the engagement state. By providing the concave portion 18*a* in the cap 18, the holding force of the boss 11*a* by the arm unit 15 can be improved.

When the arm unit 15 pivots in the direction of arrow R about the rotation fulcrum Q, the arm unit 15 is separated from the arm engagement portion 25*b* of the separation arm 25. Therefore, the urgent force of the first feed pressure spring 16 acts to increase the feed pressure of the pickup roller 12 via the arm unit 15 and the roller holder 11. In other words, the first feed pressure spring 16 as a first urging member biases the roller holder 11 so that the pickup roller 12 presses the sheet S stacked on the cassette 30.

When the pickup roller 12 rises to the third position, the second feed pressure spring 71 between the roller holder 11 and the spring holder 72 is compressed as illustrated in FIG. 6C. The roller holder 11 receives an elastic force from the second feed pressure spring 71, and the elastic force acts to increase the feed pressure of the pickup roller 12.

That is, the feed pressure acting on the sheet S when the pickup roller 12 feeds the sheet S becomes a first feed pressure N1 by the first feed pressure spring 16 and the second feed pressure spring 71 in a state where the feed pressure adjustment mechanism 70 is attached to the feed roller unit 10. The first feed pressure N1 is obtained by adding the urgent force received by the pickup roller 12 from the first feed pressure spring 16 and the elastic force received by the pickup roller 12 from the second feed pressure spring 71.

Thereafter, as illustrated in FIG. 3A, the motor M is driven to rotate the feed roller 13 and the pickup roller 12, and the sheet S is fed by the pickup roller 12. Thereafter, as described above, the toner image is transferred to the sheet S and discharged to the sheet discharge tray 9.

Attachment/Detachment of Feed Roller Unit to/from Roller Support Unit

Figure 7A:
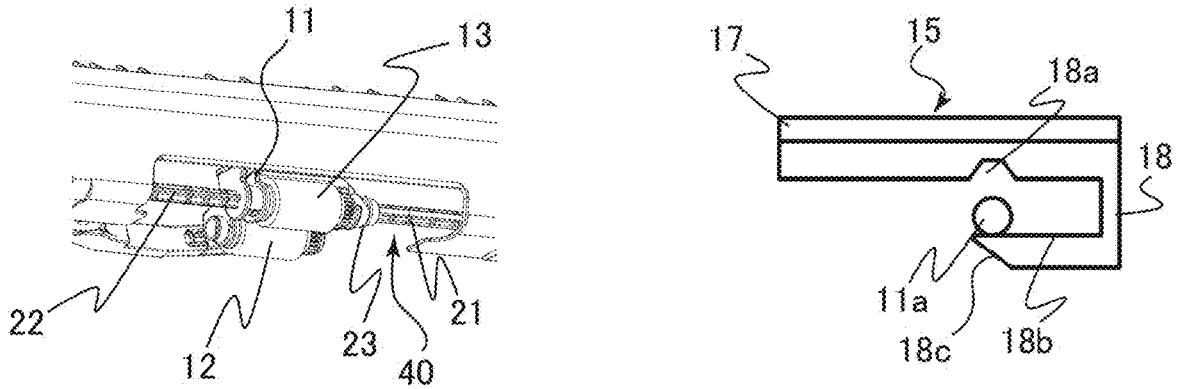
FIG. 7A is a perspective view illustrating a state in which the feed roller unit is attached to the roller support unit, and a cross-sectional view illustrating a boss and a cap at that time.
Figure 7B:
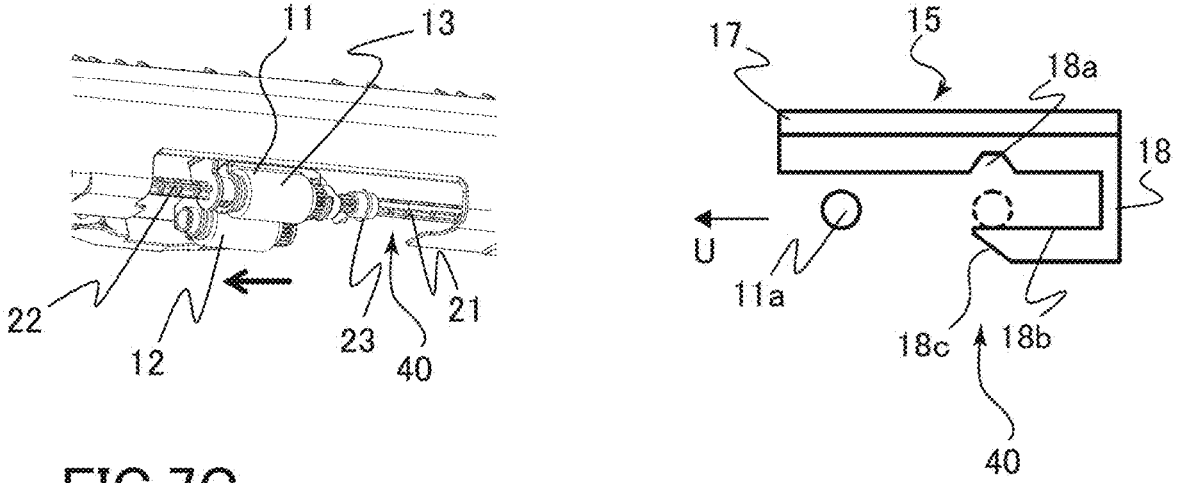
FIG. 7B is a perspective view illustrating a state in which the engagement between the feed roller unit and the roller support unit is released, and a cross-sectional view illustrating a boss and a cap at that time.
Figure 7C:
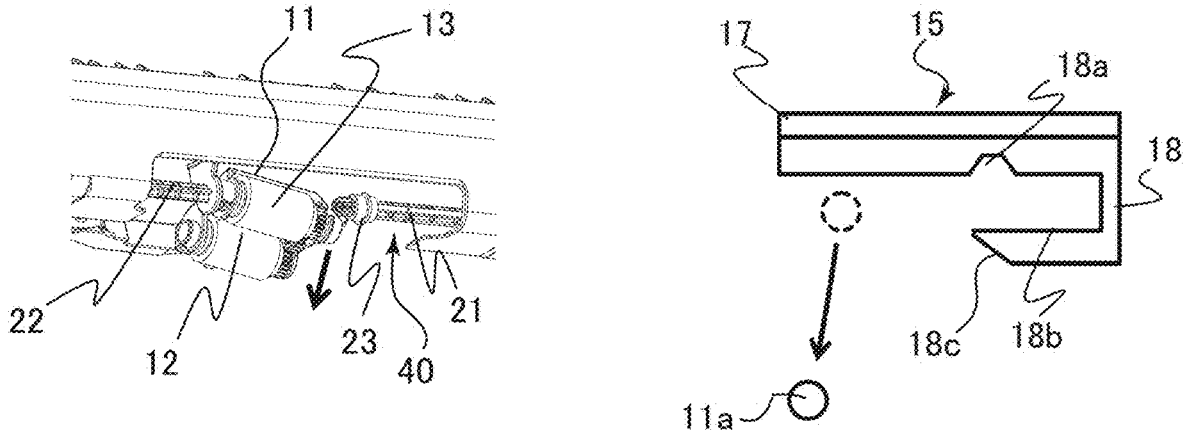
FIG. 7C is a perspective view illustrating a state in which the feed roller unit is detached downward from the roller support unit, and a cross-sectional view illustrating the boss and the cap at that time.

Next, attachment and detachment of the feed roller unit 10 to and from the roller support unit 40 will be described with reference to FIGS. 7A to 7C. FIG. 7A is a perspective view illustrating a state in which the feed roller unit 10 is attached to the roller support unit 40, and a cross-sectional view illustrating the boss 11*a* and the cap 18 at that time. FIG. 7B is a perspective view illustrating a state in which the engagement between the feed roller unit 10 and the roller support unit 40 is released, and a cross-sectional view illustrating the boss 11*a* and the cap 18 at that time. FIG. 7C is a perspective view illustrating how the feed roller unit 10 is detached downward from the roller support unit 40, and a cross-sectional view illustrating the boss 11*a* and the cap 18 at that time.

When detaching the feed roller unit 10 from the roller support unit 40, an operator such as a user or a service person first pulls out the cassette 30 from the apparatus body 1A in the pulling-out direction DD as illustrated in FIG. 1. The apparatus body 1A is provided with an opening portion 90 through which the cassette 30 passes when being attached to and detached from the apparatus body 1A. Then, the cassette 30 is detached from the apparatus body 1A through the opening portion 90.

Then, as illustrated in FIG. 7A, the feed roller unit 10 is exposed through the opening portion 90. That is, the operator can access the feed roller unit 10 through the opening portion 90. In a case where the feed pressure adjustment mechanism 70 is attached to the feed roller unit 10, the operator can access the feed pressure adjustment mechanism 70 via the opening portion 90.

At this time, the boss 11*a* provided on the roller holder 11 is engaged with the engagement portion 18*b* provided on the cap 18 of the arm unit 15. This is because, as described above, when the cassette 30 is detached from the apparatus body 1A, the arm unit 15 is pushed down in the direction of arrow R (see FIG. 3A) by the arm engagement portion 25*b* of the separation arm 25.

Next, as illustrated in FIG. 7B, the operator grips an arbitrary position of the feed roller unit 10 and slides the slide shaft 22 in the arrow direction (left direction) against the urgent force of the slide spring 24. At this time, the boss 11*a* provided on the roller holder 11 is separated from the engagement portion 18*b* of the cap 18.

Thereafter, as illustrated in FIG. 7C, the operator moves the feed roller unit 10 in the arrow direction (downward) in the left diagram of FIG. 7C. As a result, the feed roller unit 10 is detached from the feed shaft 21 and the slide shaft 22, and the boss 11*a* of the roller holder 11 is detached from the arm unit 15. As described above, the operator can detach the feed roller unit 10 from the roller support unit 40.

The procedure of attaching the feed roller unit 10 to the roller support unit 40 is reverse to the procedure of detaching the feed roller unit 10 from the roller support unit 40. The cap 18 of the arm unit 15 is provided with the tapered portion 18*c*, and the boss 11*a* presses the tapered portion 18*c* when the roller support unit 40 and the cap 18 are engaged. The tapered portion 18*c* extends in a direction intersecting a biasing direction (direction of arrow U illustrated in FIG. 5A) of the cap 18 by the cap spring 19. Therefore, when the boss 11*a* presses the tapered portion 18*c* upward, the tapered portion 18*c* slides in the direction opposite to the direction of arrow U against the urgent force of the cap spring 19. When the boss 11*a* gets over the tapered portion 18*c*, the cap 18 slides in the direction of arrow U by the urgent force of the cap spring 19, and the boss 11*a* and the engagement portion 18*b* are engaged with each other as in the state of FIG. 7A.

In the present embodiment, the feed pressure adjustment mechanism 70 is detachably supported by the feed roller unit 10. Therefore, in a state where the feed pressure adjustment mechanism 70 is attached to the feed roller unit 10, the feed roller unit 10 and the feed pressure adjustment mechanism 70 can be simultaneously detached from the roller support unit 40. In addition, the feed pressure adjustment mechanism 70 does not hinder the attaching and detaching operation when attaching and detaching the feed roller unit 10 to and from the roller support unit 40.

Adjustment of Feed Pressure

In the present embodiment, it is possible to select whether the feed pressure adjustment mechanism 70 is attached to the feed roller unit 10 or detached from the feed roller unit 10, and thus, it is possible to adjust the feed pressure of the pickup roller 12.

In particular, in a print medium having a thickness and a bulge such as an envelope, feeding failure (non-feeding and skew feeding) can be suppressed by setting the feed pressure of the pickup roller 12 to be higher than that of a general cut sheet. Specifically, when a large number of envelopes are stacked on the cassette 30 in a state where the orientations of the flaps of the envelopes are matched, the height of the stacked envelope bundle is not uniform in the sheet width direction W depending on the thickness of the flap or the folding state of the flap. As a result, the uppermost envelope of the envelope bundle may be inclined with respect to the horizontal direction. Even in such a case, by setting the feed pressure of the pickup roller 12 to be high, the swelling of the envelope bundle can be crushed and the contact surface between the pickup roller 12 and the uppermost envelope can be kept horizontal, and feeding failure can be suppressed.

However, when a general cut sheet is mainly used with a high feed pressure set as in the case of feeding an envelope, wear of the pickup roller 12 is significant, and the life of the pickup roller 12 is reduced. Therefore, it is desirable that the feed pressure of the pickup roller 12 can be easily changed according to the use application of the user.

As described in FIG. 6C, in a state where the feed pressure adjustment mechanism 70 is attached to the feed roller unit 10, the feed pressure of the pickup roller 12 becomes the first feed pressure N1 by the first feed pressure spring 16 and the second feed pressure spring 71. For example, in a case where the sheet S such as an envelope is used instead of a plain sheet such as a cut sheet, the feeding failure can be suppressed by attaching the feed pressure adjustment mechanism 70 to the feed roller unit 10.

Figure 8:
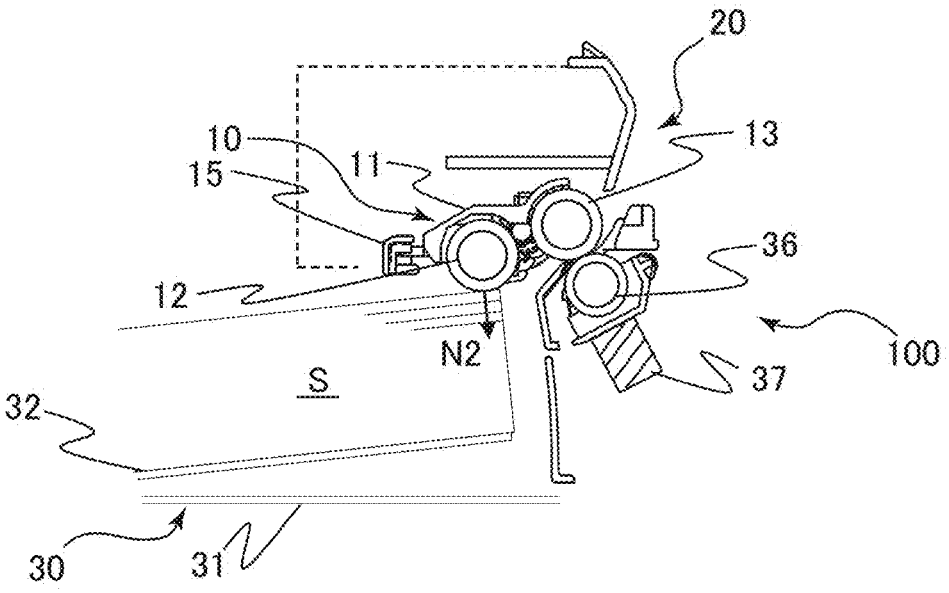
FIG. 8 is a side view for explaining the feed pressure in a state where the feed pressure adjustment mechanism is detached from the feed roller unit.

On the other hand, as illustrated in FIG. 8, in a state where the feed pressure adjustment mechanism 70 is detached from the feed roller unit 10, a second feed pressure N2 is obtained only by the first feed pressure spring 16. The second feed pressure N2 is different from the first feed pressure N1, and more specifically, is lower than the first feed pressure N1 (N2<N1). For example, in a case where the sheet S such as a cut sheet is used instead of a special sheet such as an envelope, the life of the pickup roller 12 can be extended by detaching the feed pressure adjustment mechanism 70 from the feed roller unit 10.

As described above, in the present embodiment, by attaching and detaching the feed pressure adjustment mechanism 70 to and from the feed roller unit 10, the feed pressure can be adjusted with a simple configuration and at low cost. The feed pressure adjustment mechanism 70 does not include an actuator such as a motor or a solenoid, and has a simple and low-cost configuration.

The user can select either the first feed pressure N1 or the second feed pressure N2 as the feed pressure according to the application, and it is possible to suppress feeding failure and to prolong the life of the pickup roller 12. In addition, for example, by selecting whether to attach the feed pressure adjustment mechanism 70 at the time of shipment according to the attribute of the user, it is possible to share the components between the sheet feeding apparatus to which the feed pressure adjustment mechanism 70 is attached and the sheet feeding apparatus to which the feed pressure adjustment mechanism 70 is not attached, and it is possible to reduce the cost. In addition, a user who mainly uses a cut sheet can reduce the cost and space of the sheet feeding apparatus by using the sheet feeding apparatus to which the feed pressure adjustment mechanism 70 is not attached.

Second Embodiment

Next, a second embodiment of the present invention will be described. In the second embodiment, the feed pressure adjustment mechanism 70 of the first embodiment is changed to a feed pressure adjustment mechanism 170. For this reason, a configuration similar to that of the first embodiment will be described by omitting illustration or attaching the same reference numerals to the drawings.

Figure 9A:
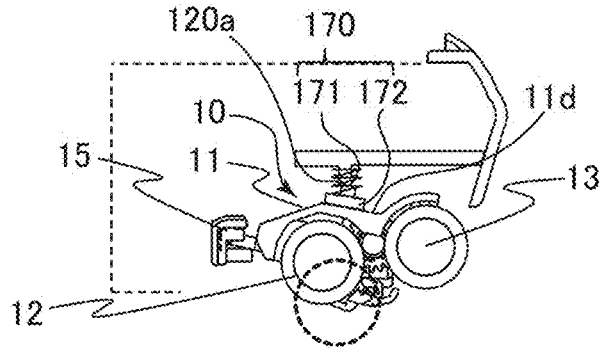
FIG. 9A is a side view illustrating a feed roller unit and a feed pressure adjustment mechanism in a state where the cassette is detached from an apparatus body according to a second embodiment.
Figure 9B:
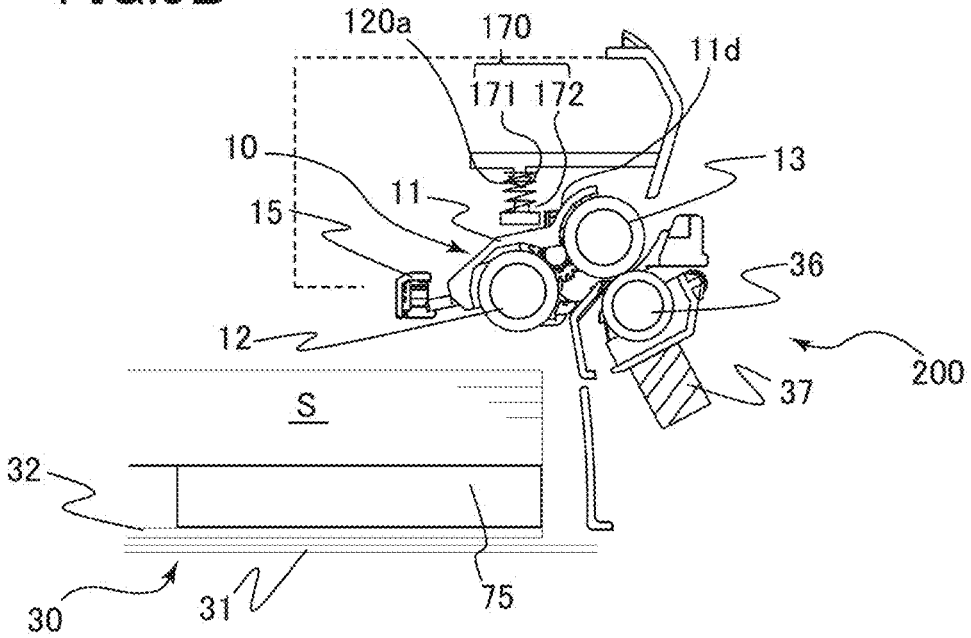
FIG. 9B is a side view illustrating the feed roller unit and the feed pressure adjustment mechanism in a state where the cassette is attached to the apparatus body.
Figure 9C:
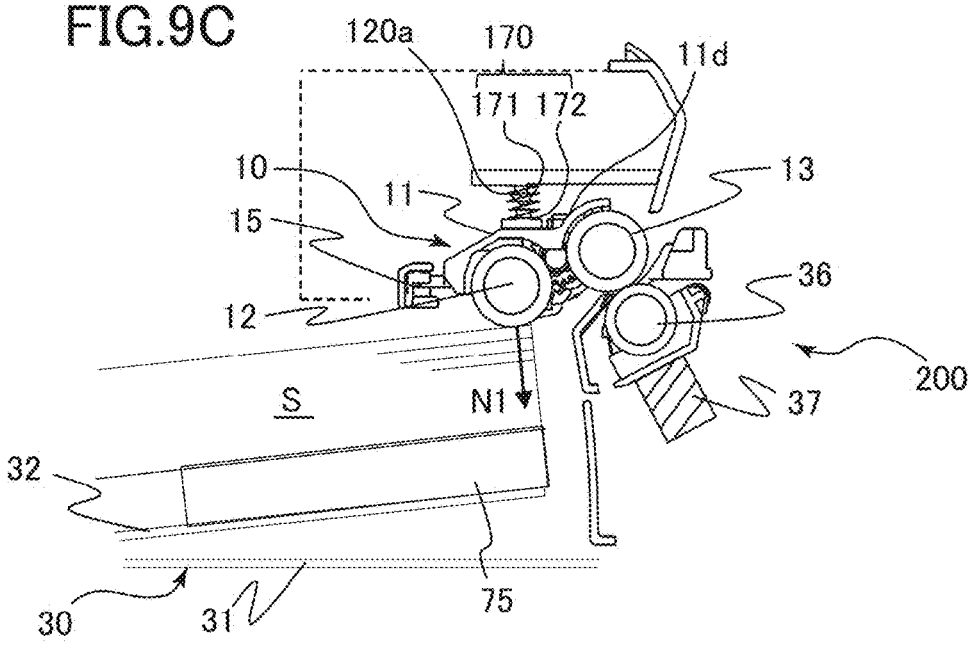
FIG. 9C is a side view illustrating the feed roller unit and the feed pressure adjustment mechanism when the intermediate plate rises from the state of FIG. 9B.

FIG. 9A is a side view illustrating the feed roller unit 10 and the feed pressure adjustment mechanism 170 in a state where the cassette 30 is detached from the apparatus body 1A according to the second embodiment. FIG. 9B is a side view illustrating the feed roller unit 10 and the feed pressure adjustment mechanism 170 in a state where the cassette 30 is attached to the apparatus body 1A. FIG. 9C is a side view illustrating the feed roller unit 10 and the feed pressure adjustment mechanism 170 when the intermediate plate 32 rises from the state of FIG. 9B.

As illustrated in FIGS. 9A to 9C, a sheet feeding apparatus 200 according to the second embodiment includes the feed pressure adjustment mechanism 170 as a detachable unit detachably supported by a spring engagement portion 120*a* provided in the apparatus body 1A.

The feed pressure adjustment mechanism 170 includes a second feed pressure spring 171 detachably attached to the spring engagement portion 120*a*, and a contact member 172 as a second contact member attached to the second feed pressure spring 171 and facing the top surface 11*d* of the roller holder 11. That is, the spring engagement portion 120*a* as the support portion is in contact with the second feed pressure spring 171 in a state where the feed pressure adjustment mechanism 170 is attached to the apparatus body 1A.

In the present embodiment, the second feed pressure spring 171 is formed of a compression coil spring, but is not limited thereto. For example, the second feed pressure spring 171 may be an elastic member such as a leaf spring, a torsion bar, a rubber member, or a sponge.

The swing mechanism 80 (see FIG. 3A) and the feed roller unit 10 of the present embodiment also operate as illustrated in FIGS. 6A to 6C described in the first embodiment. Therefore, as illustrated in FIG. 9A, when the cassette 30 is detached from the apparatus body 1A, the pickup roller 12 is located at the first position indicated by the solid line. At this time, the contact member 172 of the feed pressure adjustment mechanism 170 is in contact with the roller holder 11.

As illustrated in FIG. 9B, when the cassette 30 is attached to the apparatus body 1A, the pickup roller 12 is lowered from the first position to the second position. At this time, the contact member 172 is separated from the roller holder 11.

Further, as illustrated in FIG. 9C, when the intermediate plate 32 rises, the pickup roller 12 rises from the second position to the third position by being pressed against the uppermost sheet S stacked on the intermediate plate 32. Then, the contact member 172 is pushed up by the roller holder 11, and the second feed pressure spring 171 between the contact member 172 and the spring engagement portion 120*a* is compressed. The roller holder 11 receives an elastic force from the second feed pressure spring 171 as a second urging member, and the elastic force acts to increase the feed pressure of the pickup roller 12. In addition, similarly to the first embodiment, the urgent force of the first feed pressure spring 16 (see FIG. 3A) also acts to increase the feed pressure of the pickup roller 12 via the arm unit 15 and the roller holder 11.

That is, the feed pressure acting on the sheet S when the pickup roller 12 feeds the sheet S becomes the first feed pressure N1 by the first feed pressure spring 16 and the second feed pressure spring 171 in a state where the feed pressure adjustment mechanism 170 is attached to the apparatus body 1A. The first feed pressure N1 is obtained by adding the urgent force received by the pickup roller 12 from the first feed pressure spring 16 and the elastic force received by the pickup roller 12 from the second feed pressure spring 171.

As described above, in the present embodiment, by attaching and detaching the feed pressure adjustment mechanism 170 to and from the apparatus body 1A, the same effects as those of the first embodiment can be obtained. In addition, the feed pressure adjustment mechanism 170 is configured to be detachable from the apparatus body 1A unlike the first embodiment, but may be detachably supported by at least one of the feed roller unit 10 and the apparatus body 1A.

Third Embodiment

Next, a third embodiment of the present invention will be described. In the third embodiment, the feed pressure adjustment mechanism 70 of the first embodiment is changed to a second feed pressure spring 271. For this reason, a configuration similar to that of the first embodiment will be described by omitting illustration or attaching the same reference numerals to the drawings.

Figure 10A:
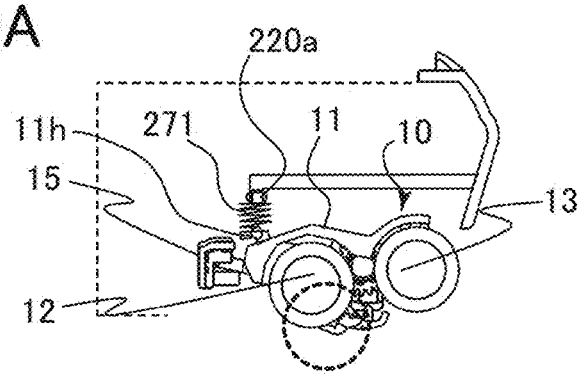
FIG. 10A is a side view illustrating a feed roller unit and a feed pressure adjustment mechanism in a state in which the cassette is detached from an apparatus body according to a third embodiment.
Figure 10B:
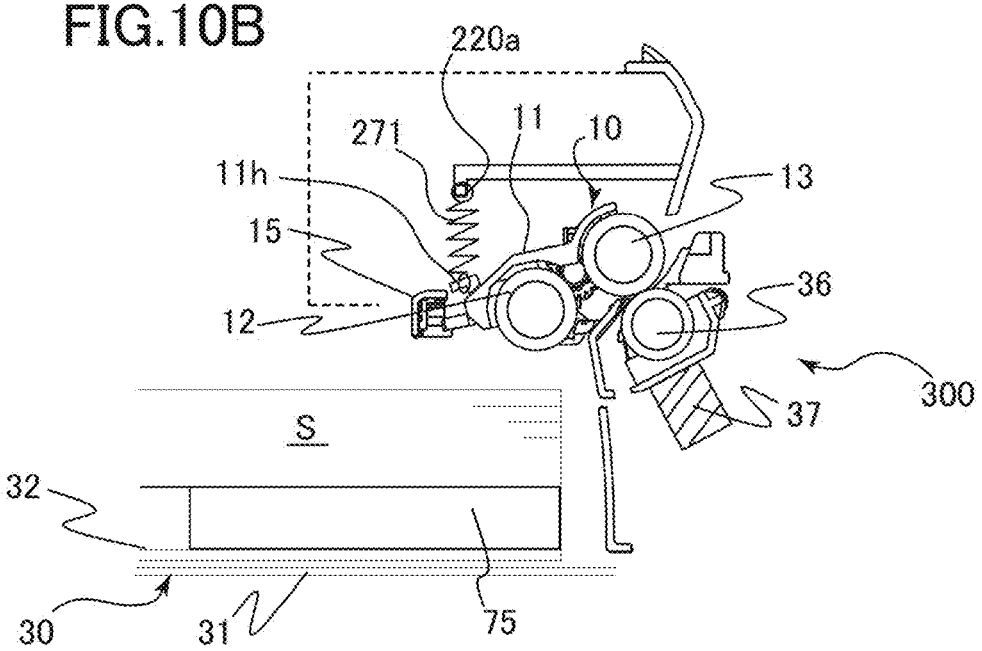
FIG. 10B is a side view illustrating the feed roller unit and the feed pressure adjustment mechanism in a state where the cassette is attached to the apparatus body.
Figure 10C:
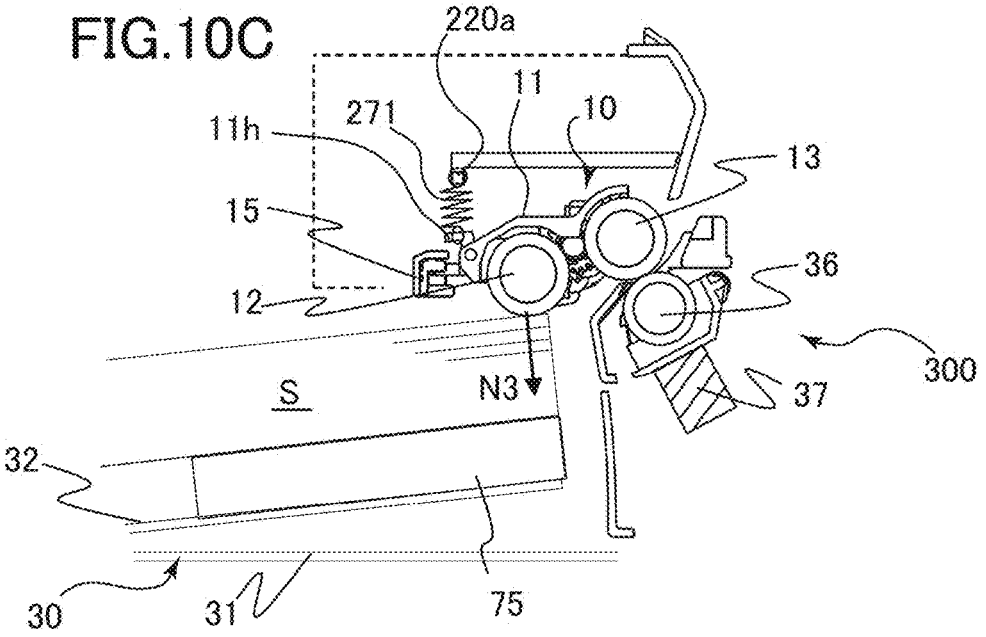
FIG. 10C is a side view illustrating the feed roller unit and the feed pressure adjustment mechanism when the intermediate plate rises from the state of FIG. 10B.

FIG. 10A is a side view illustrating the feed roller unit 10 and the second feed pressure spring 271 in a state where the cassette 30 is detached from the apparatus body 1A according to the third embodiment. FIG. 10B is a side view illustrating the feed roller unit 10 and the second feed pressure spring 271 in a state where the cassette 30 is attached to the apparatus body 1A. FIG. 10C is a side view illustrating the feed roller unit 10 and the second feed pressure spring 271 when the intermediate plate 32 rises from the state of FIG. 10B.

As illustrated in FIGS. 10A to 10C, a sheet feeding apparatus 300 according to the third embodiment includes the second feed pressure spring 271 as a detachable unit and a second urging member. The second feed pressure spring 271 is detachably supported by each of a spring hooking portion 220*a* provided in the apparatus body 1A and a hook portion 11*h* provided in the roller holder 11. That is, the spring hooking portion 220*a* and the hook portion 11*h* as the support portion are in contact with the second feed pressure spring 271 in a state where the second feed pressure spring 271 is attached to the apparatus body 1A and the feed roller unit 10. In the present embodiment, the second feed pressure spring 271 includes a tension spring that is an elastic member, but is not limited thereto. For example, a compression spring may be used instead of the tension spring. In this case, the feed pressure is increased by attaching the second feed pressure spring 271 to the spring hooking portion 220*a* and the hook portion 11*h*.

The swing mechanism 80 (see FIG. 3A) and the feed roller unit 10 of the present embodiment also operate as illustrated in FIGS. 6A to 6C described in the first embodiment. Therefore, as illustrated in FIG. 10A, when the cassette 30 is detached from the apparatus body 1A, the pickup roller 12 is located at the first position indicated by the solid line. As illustrated in FIG. 10B, when the cassette 30 is attached to the apparatus body 1A, the pickup roller 12 is lowered from the first position to the second position.

Further, as illustrated in FIG. 10C, when the intermediate plate 32 rises, the pickup roller 12 rises from the second position to the third position by being pressed against the uppermost sheet S stacked on the intermediate plate 32. Then, the second feed pressure spring 271 is compressed more than the state illustrated in FIG. 10B.

In the present embodiment, since the second feed pressure spring 271 is formed of a tension spring, the second feed pressure spring 271 has an effect of lowering the feed pressure of the pickup roller 12. In addition, similarly to the first embodiment, the urgent force of the first feed pressure spring 16 (see FIG. 3A) acts to increase the feed pressure of the pickup roller 12 via the arm unit 15 and the roller holder 11.

That is, the feed pressure acting on the sheet S when the pickup roller 12 feeds the sheet S becomes a first feed pressure N3 by the first feed pressure spring 16 and the second feed pressure spring 271 in a state where the second feed pressure spring 271 is attached to the apparatus body 1A and the feed roller unit 10. The first feed pressure N3 is obtained by adding the urgent force received by the pickup roller 12 from the first feed pressure spring 16 and the elastic force (negative value) received by the pickup roller 12 by the second feed pressure spring 271. The urgent force of the first feed pressure spring 16 is larger than the elastic force of the second feed pressure spring 271.

As described above, since the first feed pressure N3 has an effect of lowering the feed pressure, when the feed pressure in the state in which the second feed pressure spring 271 is detached from the apparatus body 1A and the feed roller unit 10, that is, the state illustrated in FIG. 8 is the second feed pressure N2, the first feed pressure N3 is smaller than the second feed pressure N2.

As described above, in the present embodiment, by attaching and detaching the second feed pressure spring 271 to and from the apparatus body 1A and the feed roller unit 10, the feed pressure of the pickup roller 12 can be adjusted with a simple configuration and at low cost.

In general, when the feed pressure of the pickup roller 12 is high, a double feeding phenomenon due to sheet separation failure is more likely to occur, and particularly in a case where the pickup roller is used in a severe environment such as a high humidity environment, a double feeding phenomenon is more likely to occur. In the case of feeding a sheet in a severe environment or a type that is likely to be double fed as described above, it is possible to perform adjustment so as to lower the feed pressure only by attaching the second feed pressure spring 271 as in the present embodiment. This makes it possible to easily prevent the double feeding phenomenon even in a severe environment or in the case of feeding a type of sheet that is easily double fed.

Fourth Embodiment

Next, a fourth embodiment of the present invention will be described. In the fourth embodiment, the feed pressure adjustment mechanism 70 of the first embodiment is changed to a weight member 371. For this reason, a configuration similar to that of the first embodiment will be described by omitting illustration or attaching the same reference numerals to the drawings.

Figure 11A:
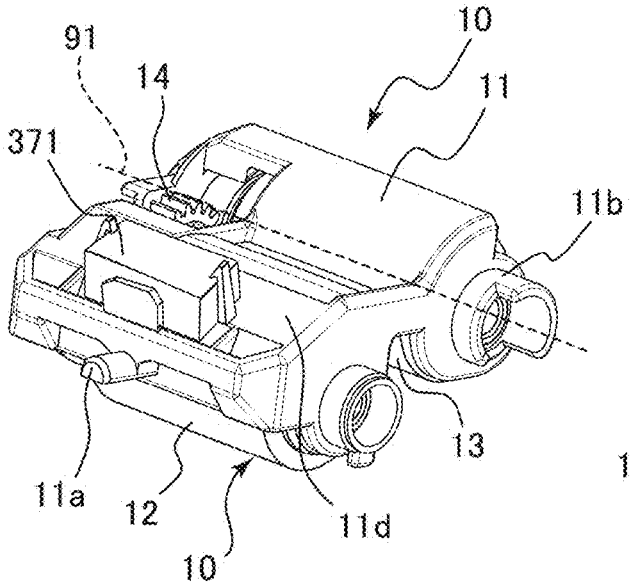
FIG. 11A is a perspective view illustrating a feed roller unit and a weight member according to a fourth embodiment.
Figure 11B:
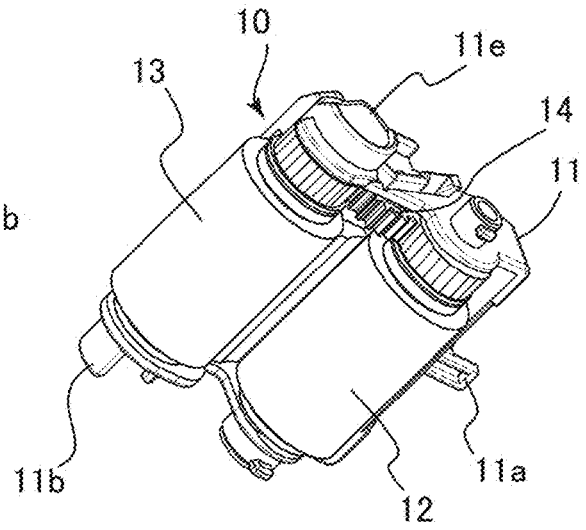
FIG. 11B is another perspective view illustrating the feed roller unit.
Figure 11C:
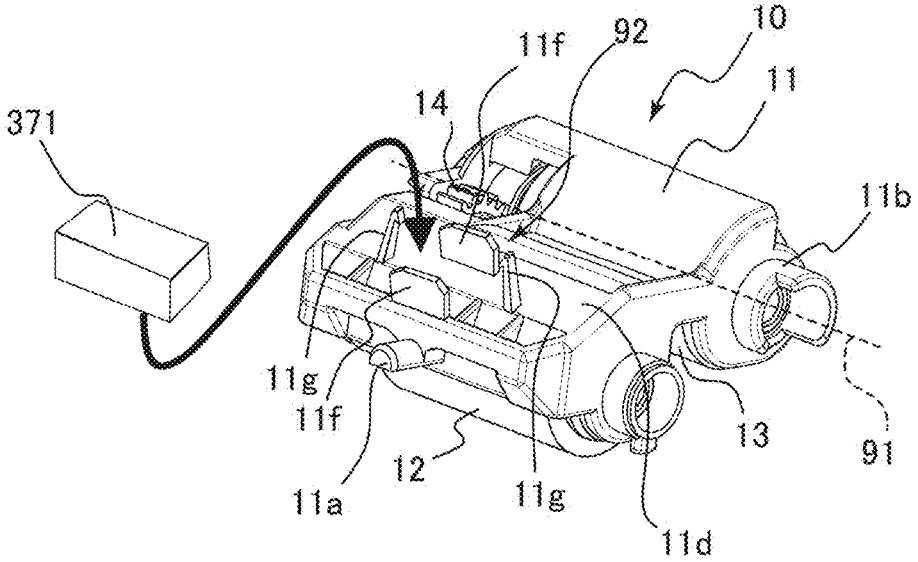
FIG. 11C is an exploded perspective view illustrating the feed roller unit and the weight member.

FIG. 11A is a perspective view illustrating the feed roller unit 10 and the weight member 371 according to the fourth embodiment, and FIG. 11B is another perspective view illustrating the feed roller unit 10. FIG. 11C is an exploded perspective view illustrating the feed roller unit 10 and the weight member 371.

As illustrated in FIGS. 11A to 11C, in the present embodiment, the weight member 371 is detachably supported by the feed roller unit 10. The roller holder 11 of the feed roller unit 10 includes a top surface 11*d* and a holding portion 92 provided on the top surface 11*d*. The holding portion 92 holds the weight member 371 on the same side as the pickup roller 12 with respect to a swing axis 91 of the roller holder 11. More specifically, the holding portion 92 includes a pair of snap fits 11*f* sandwiching the weight member 371 and a pair of ribs 11*g*. A claw portion is provided at the leading edge of the rib 11*g*, and the claw portion functions as a stopper for the weight member 371. That is, the holding portion 92 as a support portion is in contact with the weight member 371 in a state where the weight member 371 is attached to the feed roller unit 10. As described above, the holding portion 92 is configured such that the attachment work like a spring is not complicated, and the weight member 371 is easily attached and detached.

The weight member 371 as a detachable unit and a second urging member acts to increase the feed pressure of the pickup roller 12 in a state of being attached to the holding portion 92 of the roller holder 11. In addition, similarly to the first embodiment, the urgent force of the first feed pressure spring 16 (see FIG. 3A) also acts to increase the feed pressure of the pickup roller 12 via the arm unit 15 and the roller holder 11.

That is, the feed pressure acting on the sheet S when the pickup roller 12 feeds the sheet S becomes the first feed pressure N1 by the first feed pressure spring 16 and the weight member 371 in a state where the weight member 371 is attached to the feed roller unit 10. The first feed pressure N1 is obtained by adding the urgent force received by the pickup roller 12 from the first feed pressure spring 16 and the load received by the pickup roller 12 from the weight member 371. Note that the first feed pressure N1 in the present embodiment is not necessarily set to be the same as the first feed pressure N1 in the first and second embodiments.

As described above, in the present embodiment, by attaching and detaching the weight member 371 to and from the feed roller unit 10, the same effects as those of the first embodiment can be obtained. Further, the shape, material, size, and weight of the weight member 371 are not limited, and may be arbitrarily set.

OTHER EMBODIMENTS

In the present embodiment, the cassette 30 is configured to be detachable from the apparatus body 1A, but the present technology is not limited thereto. For example, instead of the cassette 30, a supporting portion may be provided integrally with the apparatus body 1A. Then, the user may cause the sheet S to be inserted and stacked on the supporting portion provided in the apparatus body 1A. In this case, the swing mechanism 80 is unnecessary, and the first feed pressure spring 16 may be separately configured to apply the feed pressure to the pickup roller 12.

In the present embodiment, the cassette 30 is provided with the intermediate plate 32 that can be movable up and down, but the present technology is not limited thereto. For example, the intermediate plate 32 may be omitted, and the pickup roller 12 may be lowered to bring the sheet S and the pickup roller 12 into contact with each other, so that the sheet S can be fed.

In the present embodiment, the roller holder 11 holds the pickup roller 12 and the feed roller 13, but the present technology is not limited thereto. For example, the roller holder 11 may hold only the pickup roller 12 to be swingable or movable up and down.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2023-215200, filed Dec. 20, 2023, which is hereby incorporated by reference herein in its entirety.

What is claimed is:

1. A sheet feeding apparatus comprising:
- an apparatus body;
- a stacking portion configured to be supported by the apparatus body and stack a sheet;
- a feed roller unit including:
  - a feed roller configured to feed the sheet stacked on the stacking portion; and
  - a holding member configured to swingably hold the feed roller;
- a first urging member configured to bias the holding member such that the feed roller presses the sheet stacked on the stacking portion; and
- a detachable unit configured to be detachably supported by at least one of the feed roller unit or the apparatus body, the detachable unit including a second urging member configured to bias the holding member,
- wherein a feed pressure applied to the sheet in a case where the feed roller feeds the sheet stacked on the stacking portion:
  - becomes a first feed pressure by the first urging member and the second urging member in a state where the detachable unit is attached; and
  - becomes a second feed pressure different from the first feed pressure by the first urging member in a state where the detachable unit is detached.

2. The sheet feeding apparatus according to claim 1, wherein the feed roller unit is configured to be detachably supported on the apparatus body.

3. The sheet feeding apparatus according to claim 1, wherein:
- the stacking portion is configured to be detachably supported with respect to the apparatus body,
- the apparatus body is provided with an opening portion through which the stacking portion passes in a case where the stacking portion is attached to and detached from the apparatus body, and
- the detachable unit is configured to be accessible from the opening portion in a state where the stacking portion is detached from the apparatus body.

4. The sheet feeding apparatus according to claim 3, further comprising:
- a swing mechanism including the first urging member, wherein the swing mechanism is configured to swing the feed roller from a first position to a second position below the first position by attaching the stacking portion to the apparatus body.

5. The sheet feeding apparatus according to claim 4, wherein:

the swing mechanism includes:

a contact portion that is in contact with the holding member; and a swing portion that swings the feed roller between the first position and the second position via the holding member, and the first urging member biases the feed roller toward the second position via the swing portion in a state where the stacking portion is attached to the apparatus body.

6. The sheet feeding apparatus according to claim 1, wherein the detachable unit is configured to be detachably supported with respect to the feed roller unit.

7. The sheet feeding apparatus according to claim 6, wherein:

the detachable unit includes a contact member configured to be brought in contact with the apparatus body, and the second urging member is provided between the holding member and the contact member in a state where the detachable unit is attached to the feed roller unit.

8. The sheet feeding apparatus according to claim 7, wherein the second urging member is an elastic member.

9. The sheet feeding apparatus according to claim 7, wherein the contact member is configured to be pivotably supported within a predetermined range with respect to the holding member such that the second urging member does not fall off in a state where the detachable unit is attached to the feed roller unit.

10. The sheet feeding apparatus according to claim 6, wherein the detachable unit includes a weight member configured to be detachably supported with respect to the feed roller unit.

11. The sheet feeding apparatus according to claim 10, wherein the holding member includes:

a top surface; and a holding portion provided on the top surface and detachably holding the weight member on a same side as the feed roller with respect to a swing axis of the holding member.

12. The sheet feeding apparatus according to claim 1, wherein the detachable unit is configured to be detachably supported with respect to the apparatus body.

13. The sheet feeding apparatus according to claim 12, wherein:

the detachable unit includes a contact member configured to be brought in contact with the holding member, and the second urging member is provided between the apparatus body and the contact member in a state where the detachable unit is attached to the apparatus body.

14. The sheet feeding apparatus according to claim 13, wherein the second urging member is an elastic member.

15. The sheet feeding apparatus according to claim 1, wherein the second urging member is configured to be detachably supported by each of the apparatus body and the feed roller unit.

16. The sheet feeding apparatus according to claim 1, wherein the stacking portion includes:

a supporting member on which the sheet is stacked; and an attachment member detachably attached to an upper surface of the supporting member, the attachment member supporting a sheet such that the sheet is swingable in a sheet width direction orthogonal to a sheet feeding direction.

17. The sheet feeding apparatus according to claim 16, wherein the attachment member is disposed so as to overlap the feed roller in the sheet width direction.

18. An image forming apparatus comprising:

the sheet feeding apparatus according to claim 1; and an image forming unit configured to form an image on a sheet fed by the sheet feeding apparatus.

19. A sheet feeding apparatus comprising:

an apparatus body;

a stacking portion configured to be supported by the apparatus body and stack a sheet;

a feed roller unit including a feed roller configured to feed the sheet stacked on the stacking portion; and a detachable unit configured to adjust a feed pressure applied to the sheet in a case where the feed roller feeds the sheet stacked on the stacking portion, wherein the detachable unit is configured to be detachably supported by at least one of the feed roller unit or the apparatus body, and wherein the feed pressure becomes a first feed pressure in a state where the detachable unit is attached, and becomes a second feed pressure different from the first feed pressure in a state where the detachable unit is detached.

20. An image forming apparatus comprising:

the sheet feeding apparatus according to claim 19; and an image forming unit configured to form an image on a sheet fed by the sheet feeding apparatus.

* * * * *